United States Patent [19]

Mottet et al.

[11] Patent Number: 4,967,686

[45] Date of Patent: Nov. 6, 1990

[54] APPARATUS FOR FORMING REFRACTORY MASSES

[75] Inventors: Léon-Philippe Mottet, Tarcienne; Emilian Wlodarski, Jumet, both of Belgium

[73] Assignee: Glaverbel, Brussels, Belgium

[21] Appl. No.: 431,173

[22] Filed: Oct. 26, 1989

Related U.S. Application Data

[60] Division of Ser. No. 241,808, Sep. 7, 1988, Pat. No. 4,911,955, which is a continuation of Ser. No. 903,989, Sep. 5, 1986, abandoned.

[30] Foreign Application Priority Data

Sep. 7, 1985 [GB] United Kingdom ..... 8522255

[51] Int. Cl.[5] ..... B05B 7/14; B05B 7/20

[52] U.S. Cl. ..... 118/300; 427/423; 239/85; 239/398; 239/416.5

[58] Field of Search ..... 427/427, 422, 423; 118/300; 239/80, 85, 416.4, 416.5, 429, 430, 398

[56] References Cited

U.S. PATENT DOCUMENTS

| | | | |
|---|---|---|---|
| 4,193,773 | 3/1980 | Staudinger | 48/210 |
| 4,560,591 | 12/1985 | Plumat | 427/422 |
| 4,634,611 | 1/1987 | Browning | 427/423 |

FOREIGN PATENT DOCUMENTS

| | | |
|---|---|---|
| 606632 | 3/1960 | Belgium . |
| 2575678 | 7/1986 | France . |
| 1330894 | 4/1973 | United Kingdom . |
| 1330895 | 9/1973 | United Kingdom . |
| 2035524 | 6/1980 | United Kingdom . |
| 02103959 | 3/1983 | United Kingdom . |
| 2144054 | 2/1985 | United Kingdom . |

OTHER PUBLICATIONS

"Metallurgical Coke", *Coal Research Establishment Annual Report* (1980–1981), pp. 8 and 9, pub'd 1981.

*Primary Examiner*—Shrive Beck
*Attorney, Agent, or Firm*—Spencer & Frank

[57] ABSTRACT

An apparatus for forming a refractory mass on a surface of a substrate by spraying against the surface a mixture of particles including oxidizable particles and refractory particles in a carrier gas, which carrier gas may contain oxygen but is not substantially all oxygen, and combusting the oxidizable particles to generate sufficient heat to soften or melt at least the surfaces of the refractory particles and form the refractory mass, which apparatus includes means for mixing the mixture of particles with a stream of the carrier gas; a lance having an outlet; a feed line for conveying the carrier gas and entrained mixture of particles to the lance outlet for spraying and having defined therein at least one orifice located downstream of the mixing means and at least 1 m from the lance outlet; and means for introducing oxygen gas into the carrier gas and entrained mixture of particles connected to the at least one orifice defined in the feed line.

12 Claims, 2 Drawing Sheets

FIG. 3
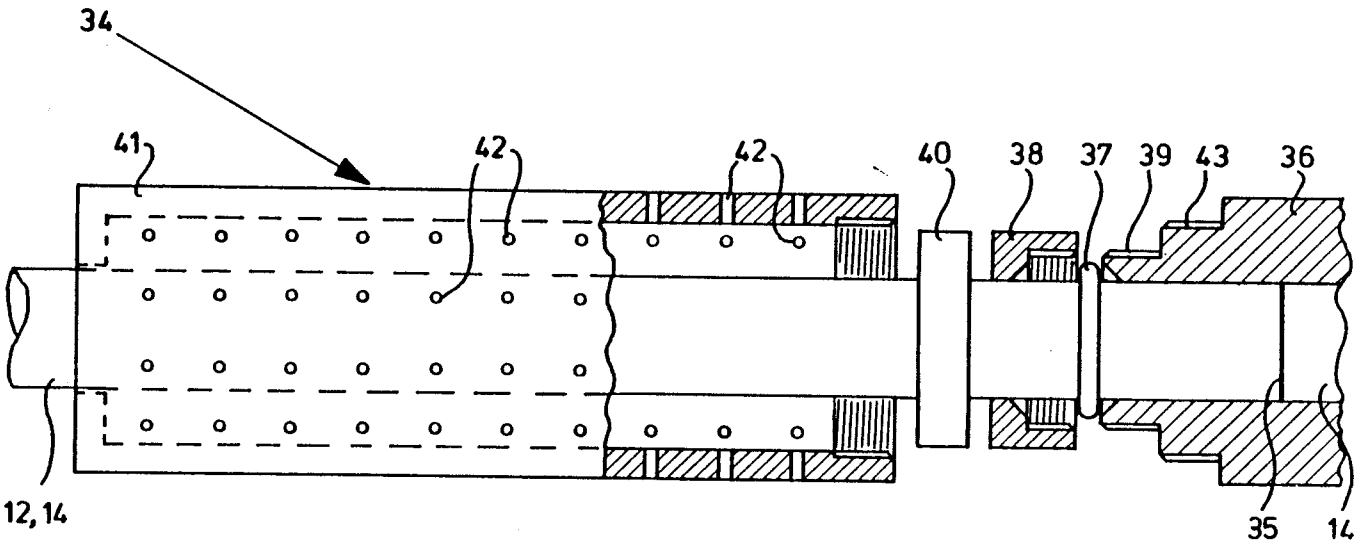
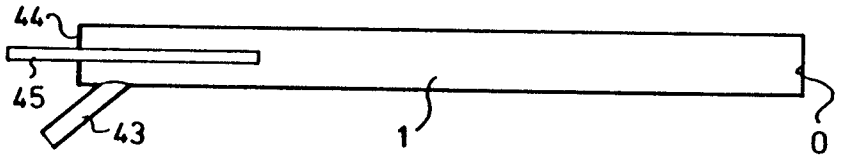
FIG. 4

APPARATUS FOR FORMING REFRACTORY MASSES

This is a Division of application Ser. No. 07/241,808 filed Sept. 7, 1988 now U.S. Pat. No. 4911955, which is a continuation of Ser. No. 06/903,989 filed Sept. 5th 1986 now abandoned.

BACKGROUND OF THE INVENTION

1. Field of the Invention

This invention relates to a process of forming a refractory mass on a surface by spraying from an outlet of a lance and against that surface a mixture of oxidisable particles and refractory particles in a comburent carrier gas so that on combustion of said oxidisable particles, sufficient heat is generated to soften or melt at least the surfaces of the refractory particles to bring about the formation of the refractory mass. The invention also relates to apparatus for forming a refractory mass on a surface by spraying against that surface a mixture of oxidisable particles and refractory particles in a comburent carrier gas so that on combustion of said oxidisable particles, sufficient heat is generated to soften or melt at least the surfaces of the refractory particles to bring about the formation of the refractory mass, which apparatus comprises means for mixing said particles with a carrier gas stream, a lance with an outlet from which they are to be sprayed, and a feed line for conveying the carrier gas and entrained particles to the lance outlet.

Such processes are useful for forming refractory coatings on refractory blocks and other surfaces, are especially suitable for repairing or strengthening furnace linings in situ, and can in some cases be used while the furnace is still operating. The processes are particularly apt for use in the repair of erosion caused by contact between refractories and molten metal, such as in furnaces, ladles and convertors used in the iron and steel industries.

2. Description of the related Art

Among previous proposals in this field are those set forth in Patent Specification Nos GB 1 330 894 (Glaverbel) and GB 2 035 524 A (Coal Industry [Patents] Limited).

As is well known, the refractory particles are chosen to confer the desired refractory properties on the mass to be formed, for example to match the chemical composition of a refractory substrate against which they are to be sprayed, or to form a higher quality refractory surface on that substrate. As oxidisable material, it is most usual to use silicon and/or aluminium particles, though particles of other materials such as magnesium and zirconium may be used where it is desired to impart special properties to the refractory mass to be formed. Of course there are other materials which could be used, but these are in general less preferred. It has been recommended to use oxidisable particles having a mean grain size below 50 μm or even below 10 μm (GB 1 330 894 A).

It is of course clearly desirable to ensure that sufficient oxygen is available for the desired extent of combustion, and the supply of a substantial excess of oxygen has been recommended. For example, GB 1 330 894 A recommends using oxygen as carrier gas, and in its Examples, specifies hourly feed rates of 60 kg mixed particles in 1200L oxygen and 30 kg mixed particles in 480L oxygen.

It is generally desirable that the refractory mass formed should contain substantially no still-oxidisable material, since the presence of such material usually detracts from the quality of that refractory mass, and entails that the unburnt material will not have been able to yield heat during spraying so that it is to that extent wasted. This would add unnecessarily to the cost of the process. Since stilloxidisable material can hardly burn when it is buried in the refractory mass being formed, it must burn during its trajectory, or while it is exposed on the surface being sprayed. In use, the outlet at the tip of the lance from which the material is sprayed is often held at a distance of some 10 to 30 cm from the surface on which the refractory mass is being formed, and it is accordingly desirable that the oxidisable material should burn rather rapidly. Such rapid burning is promoted by the use of very small oxidisable particles which are well mixed in an oxygen rich gas stream.

It is also desirable, to promote durability of the refractory mass formed, that the refractory mass should be free from porosity, especially if the refractory will be in contact with molten metal during its working life. The risk of forming a porous refractory mass is increased when large quantities of carrier gas are used.

Feeding very small oxidisable particles well mixed in an oxygen rich gas stream is most beneficial for rapid and efficient combustion on discharge from the lance: however this can also give rise to conditions under which combustion can be supported within the feed line leading to the lance outlet. This would clearly halt the process, and could lead to damage to the apparatus used. Such combustion may in some circumstances be initiated by flashback from the lance outlet if the speed of flame propagation is greater than the speed at which the material is ejected from the lance. The risk of combustion within the feed line is increased by the use of very small oxidisable particles, by increasing the weight proportion of oxidisable particles in relation to the proportion of refractory particles, by increasing the proportion of oxygen in the carrier gas stream and by increasing the diameter of the feed line. Flashback may take a relatively mild form, leading merely to blockage of the lance outlet, or it may be more serious, going right back to the point where the particles are mixed with the oxygen carrier stream. For that reason. GB 1 330 894 A recommends the use of an apparatus incorporating various safety features as set forth in GB 1 330 895 A, also in the name of Glaverbel.

GB 2 035 524 A proposes to overcome the problem of flashback by feeding the mixture of particles in a carrier gas which will not support oxidation of the oxidisable particles (air is recommended), and supplying oxygen to the lance adjacent its outlet. An hourly feed rate of 30 kg mixed particles in 3000 to 6000L air with the supply of oxygen at a volume rate of 2 to 4 times that of the air is recommended and exemplified. Clearly, no flash will be able to propagate back in a carrier gas which will not support oxidation. Further, by the choice of somewhat larger oxidisable particles, up to 152 μm, that specification suggests that the problem of lance tip blockage can be reduced. Indeed, it is stated that combustion of the mixture does not start for some distance from the lance, where sufficient mixing of the oxygen with the mixed particles is attained. Accordingly, there is a risk that unburnt oxidisable material will be incorporated in the refractory mass formed. Also the use of such large quantities of gas in relation to the quantity of particles used tends to promote the formation of a porous refractory mass.

Material feed rates as specified in those prior specifications entail rather low rates of build up of the refractory mass to be formed. In order to achieve a substantial increase in the build-up rate of the refractory material it is necessary either to use more than one feed line for the lance, which is inconvenient, or to increase the feed line diameter, so that it can accommodate a greater flow of the particle mixture. The use of a larger diameter feed line also tends to increase the risk of combustion within the feed line, since it is easier for a flame to propagate in a larger diameter pipe.

Apart from flashback from the lance outlet, there is another important potential cause of combustion within a feed line. It will be appreciated that as the particles are carried along they will collide with each other and with the walls of the feed line This will generate heat and at high carrier gas and particle velocities, which are desirable to enable rapid build up of the refractory mass being formed, this heat can be sufficient to induce spontaneous combustion of the oxidisable particles, especially when they are carried in a stream which is very rich in oxygen.

SUMMARY OF THE INVENTION

It is an object of the present invention to provide a versatile process which will allow high material delivery rates for the rapid build up of refractory material while at the same time giving an acceptably low risk of combustion within the feed line of the material being delivered.

According to the present invention, there is provided a process of forming a refractory mass on a surface by spraying from an outlet of a lance and against that surface a mixture of oxidisable particles and refractory particles in a comburent carrier gas so that on combustion of said oxidisable particles, sufficient heat is generated to soften or melt at least the surfaces of the refractory particles to bring about the formation of the refractory mass, characterised in that said mixture of particles is itself mixed with a carrier gas stream and is fed along a line towards the lance outlet and oxygen is introduced into such feed line at at least one location therealong and is mixed with the carrier gas/particle mixture during its flow towards the lance outlet, before reaching that outlet.

A process according to the present invention enables higher material delivery rates to be achieved with less risk of flashback or spontaneous combustion than would otherwise occur, and at the same time it permits highly efficient combustion of the sprayed-material as soon as it is ejected from the lance outlet, thus contributing to the rapid formation of a compact and durable refractory mass which contains little or no unburnt oxidisable material. The rapid formation of a durable refractory mass is of particular importance in the repair of refractory apparatus used for metals processing, since any repairs to such apparatus should be carried out during time allotted for cleaning the apparatus so as not to disturb the normal operating cycle of filling, processing, emptying and cleaning preparatory to refilling.

As compared with known processes in which oxygen is fed to the tip of the lance, time is allowed for the introduced oxygen to mix with the Particles, and this is beneficial for efficient combustion as has been stated. Of course this means that flashback or spontaneous combustion can under some circumstances occur in the feed line between the point where oxygen is introduced and the outlet of the lance. However the carrier gas stream into which the particles are originally mixed need not contain all the oxygen required for combustion of the oxidisable particles, and as a result, combustion will be less likely to take place in the feed line upstream of a point where the oxygen is introduced. Also the gas velocity in that upstream feed line section can be reduced for a given particle feed rate. Thus the process can easily be performed in such a way that the most sensitive and expensive part of the equipment required, namely the apparatus where the particles are mixed with the carrier gas stream, is preserved from damage. Also, any flashback or spontaneous combustion which does occur can be halted by switching off the supply of oxygen.

In some preferred embodiments of the invention, said carrier gas stream comprises an inert gas. The proportion of such inert gas in the stream can readily be adjusted to give a low risk of flashback or spontaneous combustion in the feed line upstream of the point where oxygen is introduced while at the same time allowing for efficient combustion on spraying. Such inert gas preferably comprises nitrogen. Nitrogen is inexpensive and readily available, and in some embodiments of the invention, the carrier gas into which the particles are mixed consists substantially entirely of nitrogen. It is however by no means necessary for the best performance of the process of the invention that the carrier gas into which the particles are first mixed should be free of oxygen. Indeed, in some preferred embodiments of the invention, such carrier gas comprises a proportion of oxygen since this requires less inert gas to be incorporated in the sprayed mixture, and will thus give rise to the formation of a refractory product of improved quality. Thus it is suitable to introduce the inert gas nitrogen as a constituent of air. It is preferred that the inert gas should constitute at least 30% by volume of the carrier gas stream into which the particles are mixed. A particularly recommended carrier gas stream composition (prior to the said introduction of oxygen) is 50% by volume oxygen and 50% air (i.e. approximately 60% oxygen and 40% nitrogen). Similar advantages can be given by the use of a gas which is not, strictly speaking, inert, but which nonetheless has combustion damping properties; for example carbon dioxide may be used to reduce or eliminate any ability of the carrier gas to support combustion when first mixed with the particles.

The location or locations at which oxygen is introduced into the carrier gas stream has an important bearing on the extent to which it can mix with the particle mixture during its travel along the remaining length of the flow path towards the lance outlet (or the nearest outlet if there are several such at different locations along the lance). It is found that an adequate degree of mixing for efficient combustion of the sprayed particles can occur within a remaining flow path length of less than 1 meter, but in order to promote such mixing, it is preferred that there is a said introduction of oxygen into said feed line at least 1 meter from the lance outlet.

In order to reduce the risk of spontaneous combustion within the feed line it is desirable that at least part of the oxygen to be introduced into the feed line should be introduced as far downstream as possible, consistent with allowing a sufficient remaining flow path for mixing to take place. Firstly, this tends to reduce the length of the feed line in which combustion of the oxidisable particles can be supported or can be supported easily by the gas within that line. Secondly, it is to be noted that in practice the fuel line will not be rectilinear between the region where the particles are incorporated into the carrier gas and the lance. In the apparatus usually used for processes of the kind to which this invention relates, the mixture of Particles is conveyed to the lance along a flexible feed hose. It will be apparent that frictional heat will be particularly generated at any bends, especially any sharp bends, in the feed line. It is accordingly preferred that there is a said introduction of oxygen into said feed line at or immediately before the butt of the lance.

A further important advantage of supplying at least part of the oxygen to the feed line as far downstream as possible, consistent with allowing a sufficient remaining flow path for mixing to take place is as follows. In practice, it will not usually be convenient to raise the pressure at which that gas is supplied above a given level, and accordingly the total pressure drop along the feed line will be limited. By moving a point at which oxygen is introduced along the feed line in the downstream direction, it is possible, for a given total pressure drop along the line, to increase the mass flow rate along the line, so contributing to an increase in refractory build up rate.

In some preferred embodiments of the invention, oxygen is introduced into said feed line at at least two locations spaced apart therealong. This allows a further control parameter so that a good compromise can be achieved between promoting mixing on the one hand and reducing the risks and effect of flashback and spontaneous combustion and promoting high flow rates on the other hand.

In the most preferred embodiments of the invention, said oxygen is introduced into such feed line adjacent its wall so as initially to form a sleeve between the particles and the wall of the feed line. Of course the oxygen of that sleeve will soon mix in with the main stream of carrier gas, but it provides a partial barrier against collision between the stream of particles and the wall of the feed line just downstream of the point of introduction of the oxygen so reducing the frictional heat which will be generated and militating against spontaneous combustion in the feed line.

Such oxygen could be introduced though a series of separate orifices which are distributed over a circumference of the feed line, but it is preferred that said oxygen is introduced into said feed line in an annular stream, since this provides a more uniform gas sleeve.

Advantageously, said oxygen is introduced into such feed line in a zone where such line increases in cross-sectional area. The adoption of this preferred optional feature of the invention enables that oxygen to be introduced into the carrier gas stream without creating significant back-pressure in the feed line such as might cause disruption of the flow of the particles. The adoption of this feature also enables said oxygen to be introduced into the feed line parallel to the direction of feed, and this is preferred because it tends to promote flow of the mixture of particles in the carrier stream.

In the most preferred embodiments of the invention, said particles are introduced into said carrier gas in a venturi. This is a very simple way of introducing the particles in a smooth and well-controlled manner. The use of a venturi for this purpose enables continuous feed of the particles into the carrier gas stream, and does not require the use of a pressurised container for those particles.

It has been mentioned that any flashback or spontaneous combustion which may occur during the performance of the process of the invention can be halted by switching off the supply of oxygen. There are other ways of halting such combustion, and they can be under manual control. There are however particular safety advantages in embodiments of the invention in which combustion within the feed line is halted automatically, and it is accordingly preferred that a sudden increase in back pressure in said feed line indicative of combustion within or blockage of the feed line is used to terminate feed of said particles along the feed line to the lance outlet. In some such embodiments, such increase in pressure is used to separate said feed line. This will clearly terminate feed to the lance outlet, and it can be done in an extremely simple manner by incorporating in the feed line a connector which is a tight sliding fit with a section of the feed line. The resistance to separation of such connector and line section can easily be arranged to be sufficient to accommodate normal operation while being able to be overcome by any substantial rise of pressure in the line due to combustion within the line or blockage of it. Such separation may itself be used, and it preferably is used, to halt introduction of the particle mixture into the carrier gas stream, and/or to shut off the gas stream into which the particles are introduced, in order to prevent wastage of the materials used. For example such separation can be caused to break an electrical control circuit.

Alternatively or in addition, it is preferred that a sudden increase in back pressure in said feed line indicative of combustion within or blockage of the feed line is used to initiate the introduction of inert gas into said feed line. Such introduction of inert gas will tend to smother any combustion in the feed line, and this effect is enhanced when, as is preferred, such increase in pressure is used to initiate the introduction of inert gas into said feed line in substitution for said introduction of oxygen.

The present invention extends to apparatus suitable for use in performing a process as herein defined, and there is accordingly provided apparatus for forming a refractory mass on a surface by spraying against that surface a mixture of oxidisable particles and refractory particles in a comburent carrier gas so that on combustion of said oxidisable particles, sufficient heat is generated to soften or melt at least the surfaces of the refractory particles to bring about the formation of the refractory mass, which apparatus comprises means for mixing said particles with a carrier gas stream, and a feed line for conveying the carrier gas and entrained particles to a lance outlet from which they are to be sprayed, characterised in that means is provided for introducing oxygen into the carrier gas/particle mixture via one or more orifices in said line downstream of such mixing means and at least 1 meter from the outlet of the lance.

This is a very simple apparatus for performing a process as herein defined. By appropriate choice of carrier gas stream, any substantial risk of combustion within the line can be limited to that portion of the feed line which is downstream of the oxygen introduction orifice(s) so that the most sensitive and expensive part of the equipment required, namely that where the particles are mixed with the carrier gas stream, is preserved from damage. At the same time, there remains a sufficient length of the flow path for the oxygen to become thoroughly mixed with the carrier gas stream and particles so promoting efficient combustion on ejection from the lance outlet. Also, any combustion within the line which does occur can be halted by switching off the supply of oxygen.

Preferably, there is an oxygen introduction orifice in said feed line at or immediately before the butt of the lance. This allows a simple construction of lance while postponing the introduction of at least part of the introduction of oxygen into the carrier gas/particle mixture.

In some preferred embodiments of the invention, oxygen introduction orifices are provided at at least two locations spaced apart along said feed line. This increases the versatility of the apparatus as to the quantities of oxygen which can be introduced at the various locations, so contributing to safety and efficiency of the apparatus.

Advantageously, such oxygen introduction orifice(s) is or are distributed over a circumference of said feed line at at least one position therealong. By the adoption of this feature, said oxygen can be introduced into such feed line so as to form a gas sleeve between the particles and the wall of the feed line. Of course the oxygen of that sleeve will soon mix in with the main stream of carrier gas, but it provides a partial barrier against collision between the stream of particles and the feed line just downstream of the point of introduction of the oxygen so reducing frictional heat which will be generated and militating against spontaneous combustion in the feed line.

Preferably, there is at least one annular oxygen introduction orifice, since this promotes the formation of a more uniform gas sleeve.

In preferred embodiments of apparatus according to the invention, at least one oxygen introduction orifice is provided in said feed line in a zone where such feed line increases in cross-sectional area. This enables such oxygen introduction to take place without creating any substantial back pressure in the feed line such as might be likely to disrupt the flow of particles along the feed line to the lance. The adoption of this feature also tends to prolong a gas sleeve which may be formed as referred to above, so increasing the protection afforded against spontaneous combustion within the feed line.

Advantageously, the or at least one such oxygen introduction orifice is aligned axially of said feed line. This is preferred because it results in a flow of introduced oxygen which tends to promote the flow of the particles in the carrier stream.

Preferably, said means for mixing said particles with a carrier gas stream comprises a venturi. This is a simple apparatus which enables the particles to be mixed with the carrier gas stream in a smooth and well controlled manner. The use of a venturi for this purpose enables continuous feed of the particles into the carrier gas stream, and does not require the use of a pressurised container for those particles.

It is particularly preferred that means is provided responsive to a sudden increase in back pressure in said feed line indicative of combustion within or blockage of the feed line, to terminate feed of said particles along the feed line to the lance outlet. This gives advantages of safety in operation, as it provides a means of automatically halting combustion within the line. Said termination of feed of said particles can be effected by terminating all flow along the feed line, or by halting the feed of the mixture of particles into the carrier gas.

In some preferred embodiments of the invention, such pressure responsive means is operative to separate said feed line. This will terminate all feed of the particles to the lance outlet, and it can be done in an extremely simple manner. Preferably, such pressure responsive means comprises a first tubular member slidable within a second and means for exerting a required clamping pressure between such members to resist separation thereof until the pressure within the feed line increases sufficiently to effect such separation. For example the arrangement may be such as to incorporate in the feed line a connector which is a tight sliding fit with a section of the feed line. The resistance to separation of such connector and line section can easily be arranged to be sufficient to accommodate normal operation while being capable of being overcome by any substantial rise of pressure in the line due to combustion within the line or blockage of it.

Alternatively, or in addition, it is preferred that the apparatus includes a source of inert gas and means is provided responsive to a sudden increase in back pressure in said feed line indicative of combustion within or blockage of the feed line, to connect such source to said feed line, and in such embodiments, it is preferred that such pressure responsive means is operative to to shut off said introduction of oxygen to said feed line and to connect such source of inert gas to said feed line via the or at least one oxygen introduction orifice. In this way the carrier gas can be rendered non-comburent whether by decreasing the supply of oxygen or increasing the supply of inert gas (or both) so that the thus modified carrier gas will not support combustion within the feed line.

BRIEF DESCRIPTION OF THE DRAWING

A preferred embodiment of the present invention will now be described in greater detail with reference to the accompanying diagrammatic drawings in which:

FIG. 3 is a cross-sectional view of part of a feed line connector incorporating a safety cut-off, and:

FIG. 4 is a schematic cross-sectional view of an embodiment of lance.

DESCRIPTION OF THE PREFERRED EMBODIMENT

Figure 1:
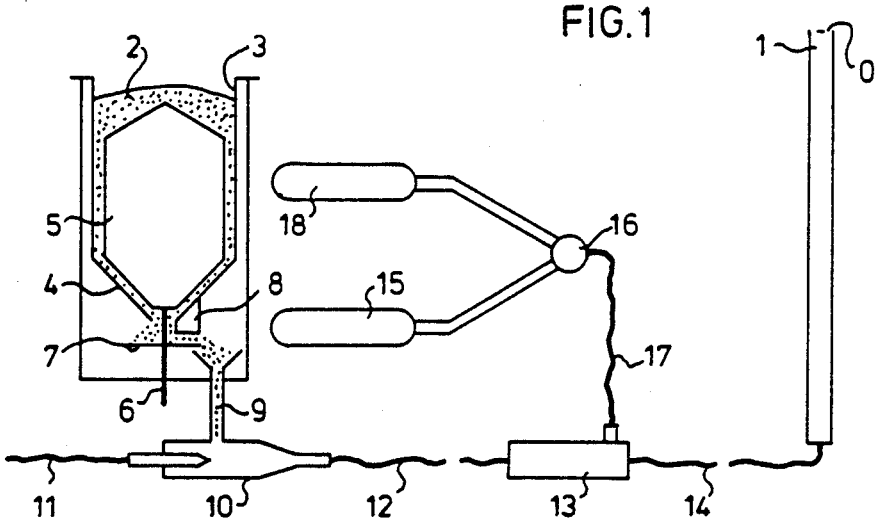
FIG. 1 is a schematic drawing illustrating an embodiment of means for feeding particulate material along a feed line to a lance.

In FIG. 1, a lance 1 having an outlet 0 is provided for spraying against a surface a mixture of oxidisable particles and refractory particles in a comburent carrier gas so that on combustion of said oxidisable particles, sufficient heat is generated to soften or melt at least the surfaces of the refractory particles to bring about the formation of a refractory mass on that surface. The desired mixture of particles 2 to be sprayed is placed in a hopper 3 having an open conical base 4 and containing a paddle 5 rotatable on a vertical axle 6. A plate 7 is carried by the axle 6 beneath the opening at the base 4 of the hopper, and a doctor 8 is provided on the outside of the hopper base for scraping material from that plate so that it will fall into a chute 9 leading to a venturi 10. A carrier gas stream is fed along a line 11 to the venturi 10 to draw particulate material to be sprayed into a flexible hose section 12 leading from the venturi 10 towards a feed line connector 13, a second flexible hose section 14 and the lance 1. A source of oxygen 15 is provided, and this is connected via a valve 16 and a flexible supplementary gas supply hose 17 to the connector 13 so that oxygen can be introduced into the carrier gas/particle mixture in the feed line 12, 13. 14, 1 before it reaches the lance outlet 0. Also connected to valve 16 is a source 18 of inert gas such as nitrogen which can be selectively fed to the connector 13 in substitution for the oxygen from source 15 should the occasion warrant.

In a variant of this embodiment, the second flexible hose section 14 is omitted and the connector 13 is attached directly to the butt end of the lance 1.

Figure 2:
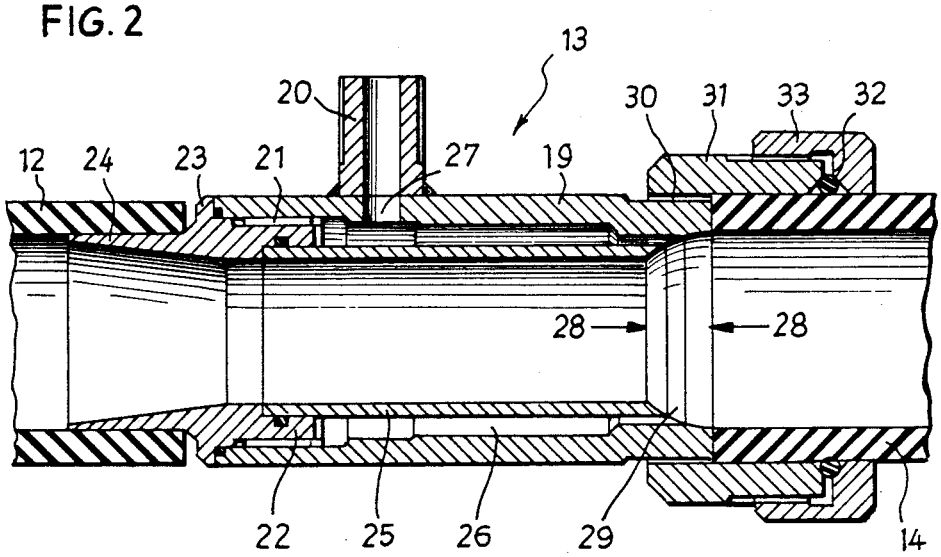
FIG. 2 is a cross-sectional view of a feed line connector incorporating means for introducing supplementary gas to the feed line.

FIG. 2 illustrates in greater detail the connector 13 and the way in which it may be attached to the feed line, whether between the flexible hose sections 12 and 14 or at the butt of the lance 1. The connector 13 comprises an outer sleeve 19 to which is welded a threaded tube 20 for connetion to the supplementary gas supply line 17. The sleeve 19 is internally threaded 21 at one end for the receipt of one end 22 of a bush 23 whose other end 24 fits into the hose section 12 leading from the venturi 10 where the particles are mixed into the carrier gas stream. That other end 24 of the bush has a tapered inner surface to promote smooth flow of material from the hose 12 and through the connector 13. The flexible hose 12 may be secured to that other and 24 of the bush in any desired manner. The upstream end of an inner sleeve 25 is secured within the threaded end 22 of the bush 23 so as to define, with the outer sleeve 19, an annular space 26 which communicates with the connetion tube 20 via a hole 27 in that outer sleeve 19. The internal surface of the inner sleeve 25 is a substantially smooth continuation of the internal surface of the tapered inner surface of the bush 23, again to promote smooth flow. At the downstream end of the inner sleeve, the internal surface of the connector 13, which defines the flow passage for the particles to be sprayed, increases in diameter and cross sectional area over a zone 28 to give a smooth transition to the internal surface of the downstream flexible hose section 14. Within this zone 28 of increasing cross section area, the annular space 26 terminates in an annular orifice 29 which is aligned co-axially with the connector 13. This enables oxygen to be introduced into the carrier gas stream without creating significant back-pressure in the feed line such as might cause disruption of the flow of the particles, and it also tends to promote flow of the mixture of particles in the carrier stream. Furthermore, by adopting this construction, the oxygen can be introduced into the feed line so as to form a sleeve between the particles and the wall of the feed line. Of course the oxygen of that sleeve will soon mix in with the main stream of carrier gas, but it provides a partial barrier against collision between the stream of particles and the feed line just downstream of the point of introduction of the oxygen so reducing the frictional heat which w!11 be generated and militating against spontaneous combustion in the feed line.

The downstream end of the outer sleeve 19 is externally threaded at 30 to receive a collar 31 into which the downstream flexible hose section 14, or lance 1, is a push fit, and a flexible 0-ring 32 surrounding that feed line section is forced against that collar 31 and the hose section 14 or lance 1 by means of a clamping ring 33. The downstream flexible feed line section 14 or lance 1 is secured to the connector 13 by the clamping forces exerted by the 0-ring 32. The clamping forces exerted by the 0-ring 32 may be adjusted so that any sudden and sufficient increase in back pressure in the feed line which would be indicative of combustion within or blockage of the feed line or of the lance outlet will cause separation of the feed line at the join between the connector 13 and the downstream feed line section constituted by the hose 14 or lance 1, and thus terminate feed of the particles to the lance outlet. Alternatively, those clamping forces may be such as to ensure retention of the downstream feed line section constituted by the hose 14 or lance 1.

In the latter case, separation of the feed line in the event of a sudden and sufficient increase in back pressure may be ensured by incorporating a further connector for example as shown in FIG. 3.

In FIG. 3, a feed line hose section such as 12 or 14 is cut at location where it is desired to insert a connector generally indicated at 34 for the automatic disconnexion of the feed line on the occurrence of an accidental excess pressure in that line. The two cut ends of the feed line hose sections are placed in abutting end-to-end relation at 35 within the body of a connector piece 36 of which only part is shown. An 0-ring 37 surrounds a portion of the feed line 12,14 and may be forced into engagement with that feed line portion by means of a collar 38 which can be screwed onto a first thread 39 on the connector piece 36 to exert the desired clamping force. A retaining collar 40 is made fast to the feed line hose section, and a cage 41 surrounding that hose section and perforated with a plurality of holes 42 may be screwed onto a second thread 43 on the connector piece 36 to enclose the two collars. The cage 41 has sufficient length for the end of the feed line hose section to leave the connector piece 36. If the pressure in the feed line 12,14,1 rises sufficiently to overcome the clamping effect of the O-ring 37, the end of the feed line hose section will slide out of the connector piece 36. but will be held captive in the cage by engagement of the retaining collar 40 with the end of the cage 41. Carrier gas can escape from the feed line through the holes 42 in the cage, and feed of material along the feed line will cease. In order to prevent any escape of flames through those holes 42, while still allowing the escape of gas, the cage 41 may if desired be surrounded with a layer of rock wool or similar flame resistant, gas permeable material. The connector may be symmetrical about the cut end line 35 of the feed line hose section 12,14, or alternatively, the other feed line portion may be securely fastened to the connector piece 36 by some other means which are not shown. In a variation which is not illustrated, the connector piece 36 is constituted as an end fitting of a lance 1 forming part of the feed line to the lance outlet 0 from which the material is to be sprayed.

FIG. 4 illustrates an embodiment of lance 1 having an outlet 0 for the spraying of a mixture of particles in a carrier gas. The lance 1 has a first connector 43 which leads obliquely into its butt end 44, at an angle of 40° to the lance axis in the embodiment illustrated, for attachment to a feed hose in which the desired mixture of particles is conveyed in a carrier gas. This carrier gas may comprise oxygen, an inert gas, or a mixture of oxygen and inert gas. Penetrating into the butt end 44 of the lance 1 is a supplementary feed connector 45 for the supply of oxygen at a rate sufficient to bring the total quantity of oxygen fed along the lance to its outlet 0 to an amount which is conducive to efficient combustion of the oxidisable particles in the mixture fed through the connector 43. In the embodiment illustrated, the lance has a total length from butt end 44 to outlet 0 of 3 meters, and the supplementary feed connector 45 penetrates some 75centimeters into the lance. The remaining length of feed line within the lance 1 is ample to ensure thorough mixing of the oxygen introduced through the supplementary feed connector 45 with the particles and the primary carrier gas before reaching the lance outlet 0.

Various examples of the invention now follow.

EXAMPLE 1

A coating was formed on a furnace wall formed of basic refractory blocks while the wall was at a temperature above 1000° C. by spraying a mixture of particles made up of 92% magnesia, 4% silicon and 4% aluminium (% by weight) delivered in a carrier gas using a lance. The magnesia used had a grain size between 100 μm and 2 mm. The silicon and aluminium particles each had an average grain size below 10 μm, the silicon having a specific surface of 4000 $cm^2/g$ and the aluminium a specific surface of 6000 $cm^2/g$.

The mixture of particles was introduced into a carrier gas stream at the venturi 10 at a rate of 970 kg/hour. The carrier gas passed through the venturi comprised 50% by volume air, the remainder being oxygen, to give a mixed carrier gas containing 60% oxygen and 40% nitrogen, and this was fed at a rate of 175 $Nm^3$ per hour.

Supplementary oxygen was introduced into the feed line to the lance at the connector 13, at a rate of 110 $Nm^3$ per hour.

The connector was located at the butt of the lance, and the lance was about 3 meter long.

Such a process gave excellent continuity of combustion of the mixture resulting in the formation of a high quality refractory mass of low porosity at a very high deposition rate, and with low risk of combustion within the feed line.

In a first variant of this Example, the mixed carrier gas passing through the venturi, again at a rate of 175 $Nm^3$ per hour, consisted of equal parts nitrogen and oxygen. This also gave excellent results.

In a second variant of this Example, the carrier gas passing through the venturi, again at a rate of 175 $Nm^3$ per hour, consisted of nitrogen. This still gave good results.

EXAMPLE 2

A number of fissures were found in a furnace wall formed of silica blocks mainly in the tridymite form. These fissures were repaired while the wall was at a temperature of 1150° C. by spraying a mixture of particles made up of 87% silica, 12% silicon and 1% aluminium (% by weight) delivered in a carrier gas using a lance. The silica used was made up of 3 parts cristoballite and 2 parts tridymite by weight With grain sizes between 100 μm and 2 mm. The silicon and aluminium particles each had an average grain size below 10 μm, the silicon having a specific surface of 4000 $cm^2/g$ and the aluminium a specific surface of 6000 $cm^2/g$.

The mixture of particles was introduced into a carrier gas stream at the venturi 10 at a rate of 600 kg/hour. The carrier gas passed through the venturi was air, fed at a rate of 170 $Nm^3$ per hour.

Supplementary oxygen was introduced into the flexible hose leading to the lance at the connector 13, also at a rate of 170 $Nm^3$ per hour.

The connector was located about 2 meters from the butt of the lance.

Such a process also gave excellent continuity of combustion of the mixture resulting in the formation of a high quality refractory mass of low porosity at a high deposition rate, and with low risk of combustion flashing back along the line to the venturi at which the particles were first introduced into the carrier gas stream.

EXAMPLE 3

Uniform layers of refractory material were deposited on electrocast Corhart Zac (Trade Mark) blocks (made of zirconia, alumina and silica) by spraying a mixture of particles while the blocks being surfaced were at a temperature of about 1200° C.

The particle mixture used was composed of 35% by weight zirconia and 53% alumina in admixture with silicon and aluminium, the silicon content of the mixture being 8% and the aluminium content being 4%.

The alumina and zirconia particles had a grain size between 50 μm and 500 μm, and the silicon and aluminium particles had the respective granulometries set out in Example 1.

The rate of discharge of the particles from the lance was 750 kg/hr. The carrier gas passed through the venturi was argon, and this was fed at a rate of 150 $Nm^3$ per hour.

Oxygen was introduced into the feed line to the lance at a first connector 13 located just downstream of the venturi 10 at a rate of 50 $Nm^3$ per hour, and supplementary oxygen was introduced into the feed line at the lance butt via a second connector 13 at a rate of 150 $Nm^3$ per hour.

Operation in accordance with this example also gave very good results in terms of the rate of deposition and the quality of the refractory mass formed, with low risk of combustion within the line flashing back to the venturi at which the particles were first introduced into the carrier gas stream.

What is claimed is:

1. Apparatus for forming a refractory mass on a surface by spraying against that surface a mixture of oxidisable particles and refractory particles in a comburent carrier gas so that on combustion of said oxidisable particles, sufficient heat is generated to soften or melt at least the surfaces of the refractory particles to bring about the formation of the refractory mass, which apparatus comprises means for mixing said particles with a carrier gas stream, and a feed line for conveying the carrier gas and entrained particles to a lance outlet from which they are to be sprayed, characterised in that means is provided for introducing oxygen into the carrier gas/particles mixture via one or more orifices in said line downstream of such mixing means and at least 1 meter from the outlet of the lance.

2. An apparatus for forming a refractory mass on a surface of a substrate by spraying against the surface a mixture of particles including oxidizable particles and refractory particles in a carrier gas, which carrier gas may contain oxygen but is not substantially all oxygen, and combusting the oxidizable particles to generate sufficient heat to soften or melt at least the surfaces of the refractory particles and form the refractory means, which apparatus comprises:

means for mixing the mixture of particles with a stream of the carrier gas;

a lance having an outlet;

a feed line for conveying the carrier gas and entrained mixture of particles to the lance outlet for spraying and having defined therein at least one orifice located downstream of the mixing means and at least 1 m from the lance outlet; and means for introducing oxygen gas into the carrier gas and entrained mixture of particles connected to the at least one orifice defined in the feed line.

3. The process of claim 2, wherein the lance further comprises a butt, wherein the apparatus has one of the at least one orifice, and wherein the oxygen gas introducing means is located at about or immediately before the butt of the lance.

4. The apparatus of claim 2, wherein the apparatus has two of the at least one orifice located at two locations spaced apart from one another along the feed line.

5. The apparatus of claim 2, wherein the feed line has a circumference and wherein the at least one orifice is positioned around the circumference at at least one position in the feed line.

6. The apparatus of claim 5, wherein the at least one orifice has an annular form.

7. The apparatus of claim 2, wherein the feed line further comprises a zone where its cross-sectional area increases and wherein the at least one orifice is provided in that zone.

8. The apparatus of claim 7, wherein the at least one orifice is aligned axially with the feed line.

9. The apparatus of claim 2, wherein the means for mixing the mixture of particles with the stream of the carrier gas further comprises a venturi.

10. The apparatus of claim 2, further comprising means for terminating the feeding of the carrier gas and entrained particles along the feed line to the lance outlet, which terminating means is responsive to a sudden increase in back pressure in the feed line resulting from combustion within or blockage of the feed line.

11. The apparatus of claim 10, wherein the means for terminating the feeding is operative to separate the feed line.

12. The apparatus of claim 10, wherein the means for terminating the feeding comprises first and second tubular members, the first tubular member being slidable within the second tubular member; and means for exerting a clamping pressure between the first and the second tubular members to resist separation thereto until the pressure within the feed line increases sufficiently to effect such separation.

* * * * *